US005579965A

United States Patent [19]

Turner

[11] Patent Number: 5,579,965

[45] Date of Patent: Dec. 3, 1996

[54] GARMENT HANGER

[76] Inventor: Robyn D. Turner, 18326 Wakecrest Dr., Malibu, Calif. 90265

[21] Appl. No.: 578,242

[22] Filed: Dec. 28, 1995

[51] Int. Cl.[6] ..... A47G 25/48

[52] U.S. Cl. ..... 223/96; 223/95; 24/510; 211/120

[58] Field of Search ..... 223/85, 88, 92, 223/96, 95; 24/510, 500, 509; 211/89, 120, 124

[56] References Cited

U.S. PATENT DOCUMENTS

| | | | |
|---|---|---|---|
| D. 183,640 | 9/1958 | Van Dusen . | |
| 632,077 | 8/1899 | Witlock | 211/89 |
| 847,644 | 3/1907 | Buckingham | 211/120 |
| 853,527 | 5/1907 | Tye . | |
| 951,628 | 3/1910 | Buckingham . | |
| 1,095,073 | 4/1914 | Bish . | |
| 1,757,981 | 3/1930 | Stephenson . | |
| 1,992,356 | 2/1935 | Dary | 223/68 |
| 2,135,846 | 11/1938 | Roberti | 223/96 |
| 2,192,167 | 3/1940 | Bagley | 211/113 |
| 2,287,473 | 6/1942 | Glines | 211/113 |
| 2,448,394 | 8/1948 | Richerzhagen | 223/96 |
| 2,492,325 | 12/1949 | Schroeder | 211/100 |
| 2,533,634 | 12/1950 | Sellers | 211/89 |
| 2,830,708 | 4/1958 | Miller | 211/120 |
| 2,902,173 | 9/1959 | Staffeld | 223/96 |
| 2,952,367 | 9/1960 | Creveling et al. | 211/113 |
| 3,071,528 | 1/1963 | Correc | 211/120 |
| 3,297,168 | 1/1967 | Fleming | 211/89 |
| 3,503,325 | 3/1970 | Aldridge | 24/509 |
| 3,910,417 | 10/1975 | Cook | 211/89 |
| 4,169,534 | 10/1979 | Donovan | 211/113 |
| 4,557,407 | 12/1985 | Boogaczykm | 223/96 |
| 4,669,152 | 6/1987 | Alexander | 24/30.5 R |
| 4,717,028 | 1/1988 | Cochanour | 211/113 |
| 4,757,906 | 7/1988 | Ovitz | 211/120 |
| 4,932,626 | 6/1990 | Guillot | 248/548 |
| 4,969,561 | 11/1990 | Yang | 211/120 |
| 5,545,489 | 10/1985 | Welch | 211/120 |

FOREIGN PATENT DOCUMENTS

| | | |
|---|---|---|
| 057857 | 4/1981 | United Kingdom . |

*Primary Examiner*—Bibhu Mohanty
*Attorney, Agent, or Firm*—Jack C. Munro

[57] ABSTRACT

A garment hanger which is composed of a plurality of elongated members which are to be mounted in a cantilevered manner on a supporting rod. Each elongated member includes a movable side panel. Each side panel is continuously biased to an outer position. A garment is to be inserted between a side panel and a directly adjacent elongated member which will result in retraction of the side panel and clamping of the garment between the side panel and the directly adjacent elongated member.

6 Claims, 1 Drawing Sheet

GARMENT HANGER

BACKGROUND OF THE INVENTION

1. Field of the Invention

The field of this invention relates in general to clothes hangers and in particular to a garment hanger to be used to hang a pair of trousers by the cuff area of the trousers so that the trousers hang in a straight configuration.

2. Description of the Prior Art

The typical clothes hanger includes a wood or wire frame which connects to a support rod. It is common to hang trousers on the support rod by the trousers being draped over the rod. Draping of the trousers over the rod will inherently cause a crease to be formed in the trousers with this crease being unsightly when the trousers are worn. Additionally, such hangers for trousers would inherently occupy twice the linear closet rod supporting space as opposed to if the trousers were hung in a straight configuration rather than being draped over the rod. In many houses and apartments, closet space is limited. Therefore, the hanging of trousers in this manner tends to utilize a great amount of the available closet space.

In order to use closet space more efficiently and also to hang trousers in a straight configuration eliminating the creating of any crease therein, it has been known to utilize a hanger that is specifically designed for trousers. The common form of a trousers hanger utilizes a pair of cross members which extend horizontally which are to be clamped together by some type of spring clamping mechanism. The cuff area of the trousers is to be positioned between the clamped together cross members. The trousers hanger is then to be supported on a typical closet rod with the trousers hanging in a straight configuration from the hanger thus preventing the formation of wrinkles and unwanted creases within the trousers.

The main disadvantage of the trouser hangers of the prior art is that such are not easily operable. The hanger needs to be removed from the closet rod, the clamping mechanism is disengaged to separate the cross members, the garment is then inserted between the cross members which are then moved to a closed position with the clamping mechanism then being engaged. The hanger is then replaced on the closet rod. It would be far more desirable to have a trousers hanger mounted in a fixed position within the closet with it is only being necessary to insert the cuff area of the trousers into engagement with the trousers hanger with that being the entire procedure to hang a pair of trousers.

SUMMARY OF THE INVENTION

A garment hanger which must comprise at least two elongated members located in juxtaposition. Normally there will be evolved several elongated members located in juxtaposition. The elongated members are identical and each include a side panel with the side panel being movable. The side panel of one elongated member is to be located directly adjacent or abutting another elongated member. The side panel is to be deflected against a spring assembly upon insertion of the cuff area of a pair of trousers in between the side panel and the directly adjacent elongated member. The spring assembly produces a clamping action that will hold the trousers in the suspended configuration. The base end of the elongated members each include a through hole with a closet rod to be passed through the through holes resulting in the elongated members being mounted on the closet rod.

Each elongated member lockingly engages with its directly adjacent elongated member. The end of the elongated members that is opposite the base end is unattached with the result that the elongated members are mounted in a cantilevered manner on the closet rod.

One of the primary objectives of the present of the invention is to provide a garment hanger capable of holding a single garment or multiple garments in a space efficient manner.

Another objective of the present of the invention is to construct a garment hanger which when used stores a garment in a manner eliminating wrinkles and unsightly creases.

Another objective of the present of the invention is to provide a garment hanger that permits for quick attachment of a garment to the hanger and also facilitates the removal of the garment from the hanger when it is desired to wear the garment.

Another objective of the present of the invention is to provide a garment hanger that can be easily used by individuals with disabilities such as people with arthritis.

Another objective of the present of the invention is to provide a garment hanger that contributes to efficient use of space within a closet.

Another objective of the present of the invention is to construct a garment hanger that can be manufactured at a relatively low cost and thereby sold to the consumer at a relatively inexpensive price.

Another objective of the present of the invention is to provide a garment hanger which is constructed of few parts assembled in a non-complex manner which thereby minimizes the cost of manufacture.

DETAILED DESCRIPTION OF THE PREFERRED EMBODIMENT

Figures 1, 2, 3:
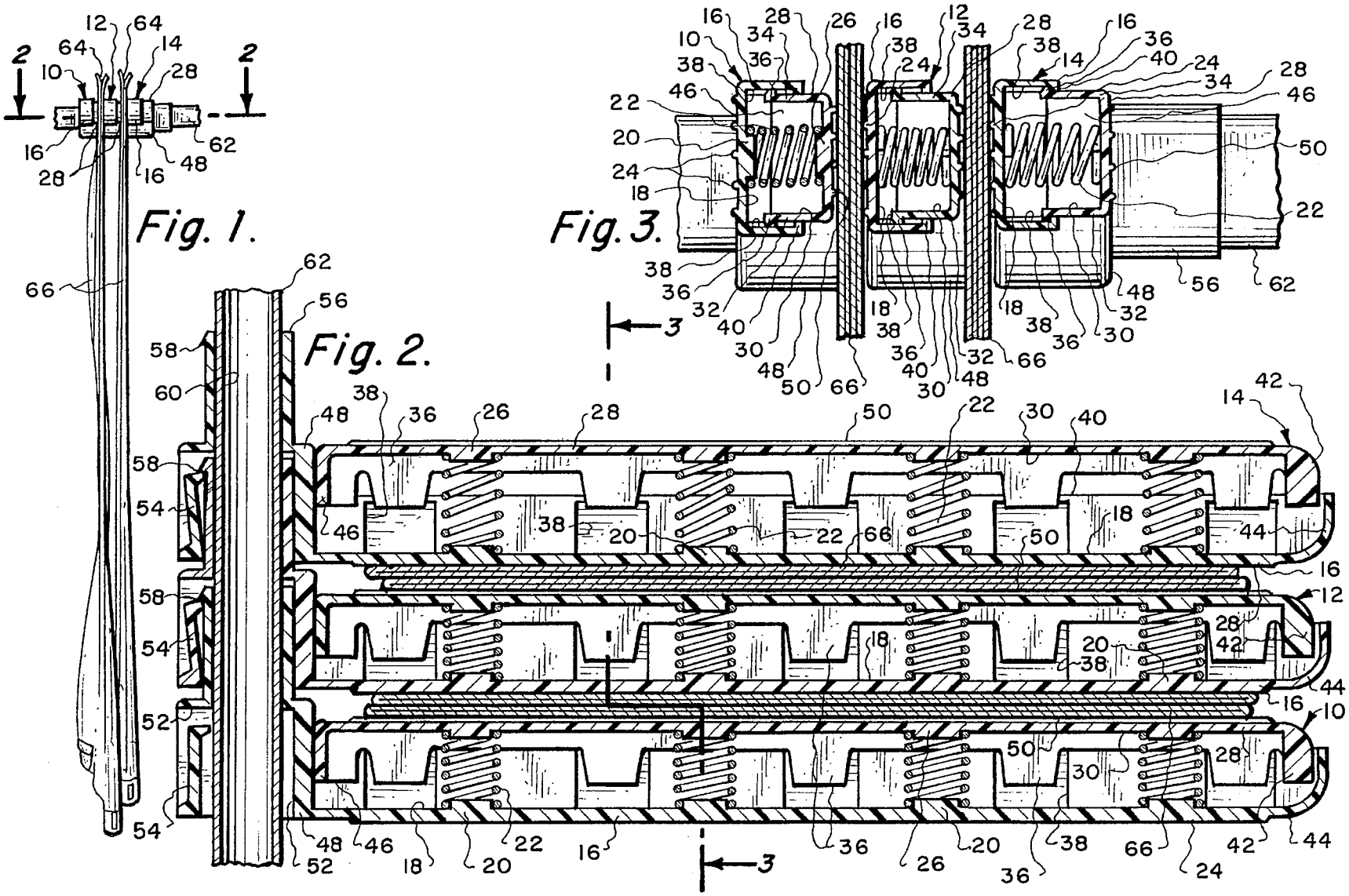
FIG. 1 is a front elevational view of the garment hanger of the present of the invention showing the garment hanger being utilized to support a pair of trousers in a suspended manner.
FIG. 2 is a cross-sectional view to the garment hanger of the present of the invention taken along line 2—2 of FIG. 1.
FIG. 3 is a cross-sectional view to the garment hanger of the present of the invention taken along line 3—3 of FIG. 2.

Referring particularly to the drawing there is shown a first elongated member 10, a second elongated member 12 and a third elongated member 14. The elongated members 10, 12 and 14 are identical with it being understood that like numerals will be used to refer to like parts. Each elongated member 10, 12 and 14 includes a base member 16. The base member 16 is to be constructed of a rigid sheet plastic material and is configured to form an enclosing internal chamber 18. Integrally formed with the bottom wall of the internal chamber 18 are a plurality (four in number) of spaced apart protuberances 20. A compression coil spring 22 is to connect with each protuberance 20. The exterior surface of the bottom wall of the base member 16 includes a plurality of spaced apart ridges 24.

Each coil spring 22 connects with a protuberance 26 which is integrally formed on the inside surface of a side panel 28. The side panel 28 is constructed to be basically hollow forming an internal chamber 30. The side panel 28 includes side walls 32 and 34. Each side wall 32 and 34 includes a plurality of evenly spaced apart depending hook members 36. Each hook member 36 is to rest within a concavity 38 formed within the side walls of the base member 16. The side panel 28 is capable of movement relative to the base member 16 from a retracted position shown by first elongated member 10 in FIG. 3 to an outer position shown by third elongated member 14 in FIG. 3. When in the outer position, the hook members 36 abut against the edge wall 40 hence functioning as a stop to limit the degree of movement. The free outer end of each of the side panels 28 is formed into a smoothly contoured forward wall 42. Forward wall 42 is to connect with smoothly contoured forward wall 44 and first outer end of the base member 16 thereby enclosing the internal chambers 18 and 30 to the ambient even when the side panel 28 is in the outer position. The side panel 28 includes a rear wall 46 which is to abut continuously against the first base end of sleeve section 48 which is integrally formed to the base member 16. The exterior surface of the side panel 28 also includes a series of elongated spaced apart ridges 50.

Sleeve 48 includes an internal cavity 52. Sleeve 48 also includes a catch 54 which is located within the internal cavity 52. The catch 54 is constructed of slightly flexible plastic material and is to be deflectable slightly in an outward direction. Integrally attached to the sleeve 48 is a tube 56. The portion of the tube 56 that is located furthest from the base member 16 includes a hook 58. The tube 56 includes a longitudinal through opening 60. A closet rod 62 is to be located in a close fitting manner within the longitudinal opening 60. Normally the closet rod 62 will not be of a circular configuration with generally an oblong configuration being preferred. This is important as it is desirable to not have the elongated members 10, 12 and 14 pivot on the closet rod 62 but will remain in position. It is to be understood that the through opening 60 will be of the same configuration as the closet rod 62.

The first elongated member 10 is installed on the closet rod 62 with the closet rod 62 being located within the longitudinal through opening 60 of its tube 56. Then the second elongated member 12 is installed on the closet rod 62 until tube 56 of member 10 rests within the internal cavity 52 of member 12. As the sleeve 48 of the second elongated member 12 is moved closer to sleeve 48 of the first elongated member 10, the catch 54 of member 12 will deflect over the hook 58 which is formed on the tube 56 which is integral with the sleeve 48 of the first elongated member 10. Catch 54 in cooperation with the hook 58 then functions as a locking device to fix in position the second elongated member relative to the first elongated member. In this position the ridges 50 would be located directly adjacent or actually abutting the ridges 24 with there being a small gap located between the side panel 28 of the first elongated member 10 and the base member 16 of the second elongated member 12. When the trousers 66 are mounted in position within the hiatused gap area between a side panel 28 and a base member 16, the ridges 24 and 50 function to increase the friction of the clamping action so as to insure that the trousers 66 will be clamped and held in position. This installing procedure is to be repeated for the third elongated member 14 and for any additional elongated members which are not shown in the drawings. Normally there will be installed on a single closet rod 62 something in the range of ten to twenty of the elongated members 10, 12 and 14.

The user is to grasp the cuff area 64 of a pair of trousers 66 and slide such within the gap between side panel 28 of the first elongated member 10 and the base member 16 of the second elongated member 12. When this sliding occurs, the side panel 28 deflects compressing the coil springs 22. Upon manual release of the cuff area 64 of the trousers 66 the coil springs 22 will exert a clamping force clamping the trousers 66 between the side panel 28 and the base member 16. This installing procedure for a pair of trousers is to be repeated in the gap area between the second elongated member 12 and the third elongated member 14 and likewise for any additional elongated members which are not shown. The result is that trousers 66 hang in a straight upside-down configuration so that there will be no creases or wrinkles created by the hanging procedure.

When it is desired to utilize a pair of the hung trousers, it is only necessary to grab the trousers 66 and give an outward yanking motion which will cause the trousers 66 to be disengaged from the gap area between cantilevered elongated members 10 and 12 or 12 and 14.

It is to be understood that the rod 62 could comprise a closet rod that is mounted across vertical side walls of a space located within a closet. However the rod 62 could be a separate rod with there being a separate hanger (not shown) that would be utilized to attach the rod 62 to a conventional closet rod.

Another advantage of this invention is that substantial deflection of the side panel 28 is permitted. This substantial deflection against the bias of the coil springs 22 is so as to accommodate garments of different thicknesses and widths and also to accommodate more than one pair of trousers if one chooses to hang a plurality of trousers on one hanger.

What is claimed is:

1. A garment hanger comprising:

a first elongated member having a pair of ends defined as a first base end and a first outer end, a first side panel mounted on said first elongated member and located in between said first base end and said first outer end, said first side panel being movable between a first outer position and a first retracted position, said first side panel being continuously biased by first biasing means towards said first outer position;

a second elongated member having a pair of ends defined as a second base end and a second outer end; and said second elongated member being located by connection means directly adjacent to said first elongated member with said first side panel being located directly adjacent to said second elongated member with said first elongated member being in juxtaposition with said second elongated member, wherein a garment is to be inserted between said first side panel and said second elongated member for retracting said first side panel to said first retracted position and clamping the garment between said first side panel and said second elongated member by outward pressure created by said first biasing means.

2. The garment hanger as defined in claim 1 including:

a third elongated member having a pair of ends defined as a third base end and a third outer end; and a second side panel mounted on said second elongated member and located in between said second base end and said second outer end, said second side panel being movable between a second outer position and a second retracted position, said second side panel being continuously biased by second biasing means towards said second outer position; and said third elongated member being located by connection means directly adjacent to said second elongated member with said second side panel located directly adjacent to said third elongated member with said third elongated member being in juxtaposition with said second elongated member, wherein a garment is to be inserted between said second side panel and said third elongated member for retracting said second side panel to said second retracted position and clamping the garment between said second side panel and said third elongated member by outward pressure created by said second biasing means.

3. The garment hanger as defined in claim 1 wherein:

said first biasing means comprising of plurality of coil springs.

4. The garment hanger as defined in claim 1 wherein:

said first side panel having a first hiatused outer surface, said second elongated member having a second hiatused outer surface, whereby said first and second hiatused outer surfaces functioning to increase friction in clamping of said garment.

5. The garment hanger as defined in claim 1 wherein:

said first side panel extends the majority of the length of said first elongated member.

6. The garment hanger as defined in claim 1 wherein said connection means comprises:

said first base end having a first through hole, said second base end having a second through hole, a support rod to be extended through said first through hole and said second through hole, said first base end being secured to said second base end by a locking means.

* * * * *